United States Patent [19]

Sakurai

[11] Patent Number: 5,056,249

[45] Date of Patent: Oct. 15, 1991

[54] SOUND-SENSITIVE DANCING TOY

[75] Inventor: Koichi Sakurai, Gumma, Japan

[73] Assignee: Sakuraya Corporation, Japan

[21] Appl. No.: 517,733

[22] Filed: May 2, 1990

[30] Foreign Application Priority Data

May 16, 1989 [JP] Japan ..... 1-121732

[51] Int. Cl.[5] ..... G09F 19/08

[52] U.S. Cl. ..... 40/414; 40/411; 40/455; 446/193

[58] Field of Search ..... 40/411, 414, 415, 421, 40/423, 427, 429, 455, 457; 446/188, 193, 175; 272/31 R; 362/122

[56] References Cited

U.S. PATENT DOCUMENTS

| | | | |
|---|---|---|---|
| 985,545 | 2/1911 | Pflasterer | 272/31 R |
| 1,263,211 | 4/1918 | Conrad | 40/411 |
| 3,146,955 | 9/1964 | Sabaco | 362/122 |
| 3,641,703 | 2/1972 | Tepper et al. | 446/193 |
| 4,180,932 | 1/1980 | Millard | 40/411 |
| 4,389,811 | 6/1983 | Iwaya et al. | 446/193 |
| 4,753,436 | 6/1988 | Sinclair | 272/31 R |
| 4,864,607 | 9/1989 | Mitamura | 40/457 |
| 4,890,828 | 1/1990 | Hou | 272/31 R |
| 4,903,424 | 2/1990 | Satoh et al. | 40/414 |

*Primary Examiner*—Peter R. Brown
*Assistant Examiner*—Brian K. Green

[57] ABSTRACT

In an artificial-flower toy apparatus operative in response to sensing of external sound, a sound-sensing operational unit is contained within a container and includes a motor which has a driving shaft. The sound-sensing operational unit senses the external sound to drive the motor. An artificial-flower dancing unit is contained within the container and includes an angularly movable shaft and at least one artificial flower which has a stem and a core rod inserted in the stem. The core rod of the artificial flower has a lower end portion which is connected to the angularly movable shaft for angular movement therewith about an axis of the angularly movable shaft. The artificial flower is mounted on the container in an upstanding manner. The angularly movable shaft is interlocked with the driving shaft of the motor for angular movement about the axis of the angularly movable shaft, so that the artificial flower is danced by the motor of the sound-sensing operational unit.

9 Claims, 6 Drawing Sheets

SOUND-SENSITIVE DANCING TOY

BACKGROUND OF THE INVENTION

The present invention relates to an artificial-flower toy apparatus operative in response to sensing of sound, in which the sound is sensed to dance at least one artificial flower.

Conventionally, there has been proposed a system in which a motor is driven to operate a crying mechanism for crying an artificial bird or the like, to operate a vertically moving mechanism for vertically moving the artificial bird or the like, or to operate a lightening mechanism for lightening one or more miniature electric bulbs.

However, the various mechanisms including the crying mechanism, the vertically moving mechanism and the lightening mechanism and so on are operated independently of each other.. Thus, such mechanisms lack in taste.

SUMMARY OF THE INVENTION

It is therefore an object of the invention to provide an artificial-flower toy apparatus operative in response to sensing of sound, in which at least one artificial flower dances windingly or meanderingly so that the artificial-flower toy apparatus is extremely rich in taste.

According to the invention, there is provided sound-sensitive dancing toy operative in response to sensing of external sound, comprising:

a container;

sound-sensing operational means contained within the container and including motor means having driving shaft means, the sound-sensing operational means sensing the external sound to drive the motor means; and artificial-flower dancing means contained within the container and including angularly movable shaft means and at least one artificial flower which has a stem and a core rod inserted in the stem, the core rod of the artificial flower having a lower end portion which is connected to the angularly movable shaft means for angular movement therewith about an axis of the angularly movable shaft means, the artificial flower being mounted on the container in an upstanding manner, wherein the angularly movable shaft means is interlocked with the driving shaft means of the motor means for angular movement about the axis of the angularly movable shaft means, so that the artificial flower is danced by the motor means of the sound-sensing operational means.

With the arrangement of the invention, when the sound-sensing operational means senses the external sound such as hand clapping, a voice of mankind or the like, the motor means is driven. Accompanied with the driving of the motor means, the angularly movable shaft means of the artificial-flower dancing means is moved angularly about the axis of the angularly movable shaft means. Accompanied with the angular movement of the angularly movable shaft means, the core rod within the stem of the artificial flower is moved angularly about the axis of the angularly movable shaft means so that it is seen that the artificial flower dances windingly or meanderingly. Thus, the artificial-flower toy apparatus is extremely rich in taste.

Preferably, the artificial-flower toy apparatus further includes at least one toy and crying means for crying the toy. The crying means comprises:

flute means having piston means and bellows means;

cam means having driving gear means, a bellows operational cam surface and a sound-interval regulating cam surface;

crying lever means having one end thereof in contact with the bellows operational cam surface and the other end supported by the bellow means;

sound-interval regulating lever means having one end thereof in contact with the sound-interval regulating cam surface of the cam means and the other end supported by the piston means of the flute means;

intermediate gear means through which the driving gear means of the cam means being interlocked with the driving shaft means of the motor means for angular movement about an axis of the cam means; and crying stop means located at the bellows means of the flute means for angular movement about an axis of the crying stop means, wherein the crying stop means has, at its lower end, eccentric projection means for being abutted against the bellows means and, at an upper end, operational knob means for angularly moving the eccentric projection means about the axis of the crying stop means to abut the eccentric projection means against the bellows means thereby disengaging the crying lever means from the bellows operational cam surface.

With the above arrangement of the invention, the driving gear means of the cam means of the artificial-flower dancing means is moved angularly about the axis of the cam means through the intermediate gear means. Accompanied with the angular movement of the driving gear means, the crying lever means having the one end in contact with the bellow operational cam surface is angularly moved about an axis of the crying lever means, and the sound-interval regulating lever means having the one end in contact with the sound-interval regulating cam surface is angularly moved about an axis of the sound-interval regulating lever means, so that the bellows means and the piston means of the flute means are operated to generate crying sound approximate to a crying voice of a natural bird, a crying voice of a doll or the like. It seems that the toy such as an artificial bird, a doll or the like cries. Thus, the artificial-flower toy apparatus is extremely rich in taste.

Preferably, the cam means further includes a vertically moving cam surface. The artificial-flower toy apparatus further includes vertically moving means for vertically moving the toy. The vertically moving means comprises:

vertically movable lever means having a substantially central section in a longitudinal direction of the vertically movable lever means, and follower projection means arranged at the substantially central section; and vertically moving arm means having an upper horizontal section on which the toy is mounted, wherein the follower projection means is in contact with the vertically moving cam surface of the cam means, and wherein the vertically movable arm means is supported by a forward end of the vertically movable lever means so that the vertically movable lever means is movable angularly about an axis thereof.

With the above arrangement of the invention, the follower projection means of the vertically moving lever means of the vertically moving means is in contact with the vertically moving cam surface of the cam means of the crying means, and the vertically movable lever means is angularly movable vertically about the axis thereof. Further, the toy such an artificial bird or a doll is moved vertically through the vertically movable arm means. Thus, the artificial-flower toy apparatus is extremely rich in taste.

Preferably, the artificial-flower toy apparatus further includes lightening means having at least one miniature electric bulb which is fitted in a center of a group of petals of the artificial flower. The lightening means utilizes current flowing through the motor means of the sound-sensing operational means to lighten the miniature electric bulb.

With the above arrangement of the invention, in response to driving of the motor means of the sound-sensing operational means, the miniature electric bulb at the center of the group of petals of the artificial flower is lightened. Thus, the artificial-flower toy apparatus is extremely rich in taste.

Preferably, the crying means is interlocked with the artificial-flower dancing means for crying the toy, and the vertically moving means is interlocked with the crying means to vertically move the toy.

With the above arrangement of the invention, the sound-sensing operational means senses the external sound such as hand clapping, a voice of mankind or the like to drive the motor means. Accompanied with the driving of the motor means, the artificial flower dances windingly or meanderingly, the toy such as an artificial bird, a doll or the like is moved vertically, and the miniature electric bulb at the center of the group of petals of the artificial flower is lightened. In this manner, various means including the sound-sensing operational means, the artificial-flower dancing means, the crying means, the vertically moving means and the lightening means are operated simultaneously. Thus, the artificial-flower toy apparatus is further rich in taste.

DESCRIPTION OF THE EMBODIMENTS

Figure 1:
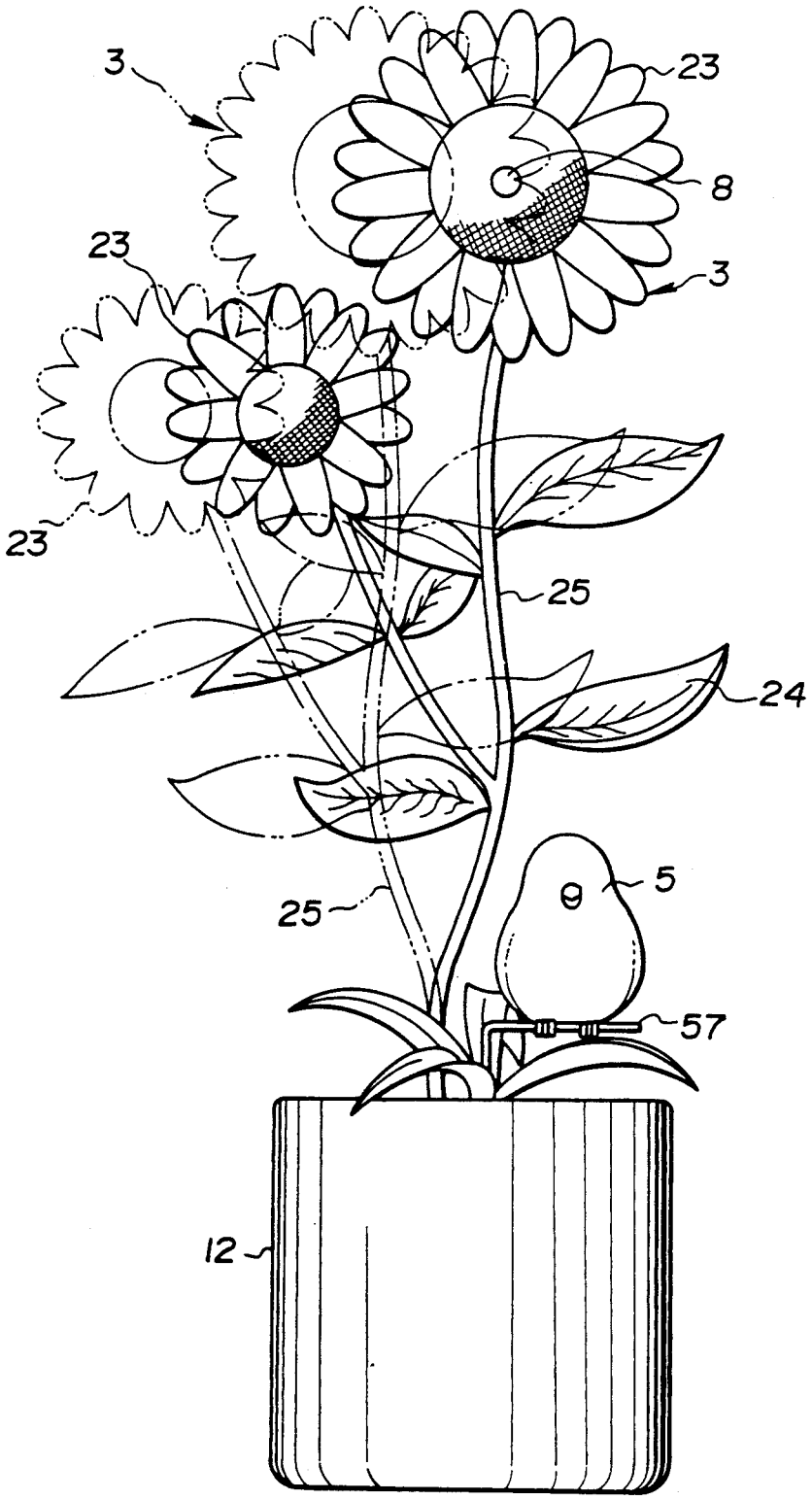
FIG. 1 is a front elevational view of an artificial-flower toy apparatus according to an embodiment of the invention.
Figure 2:
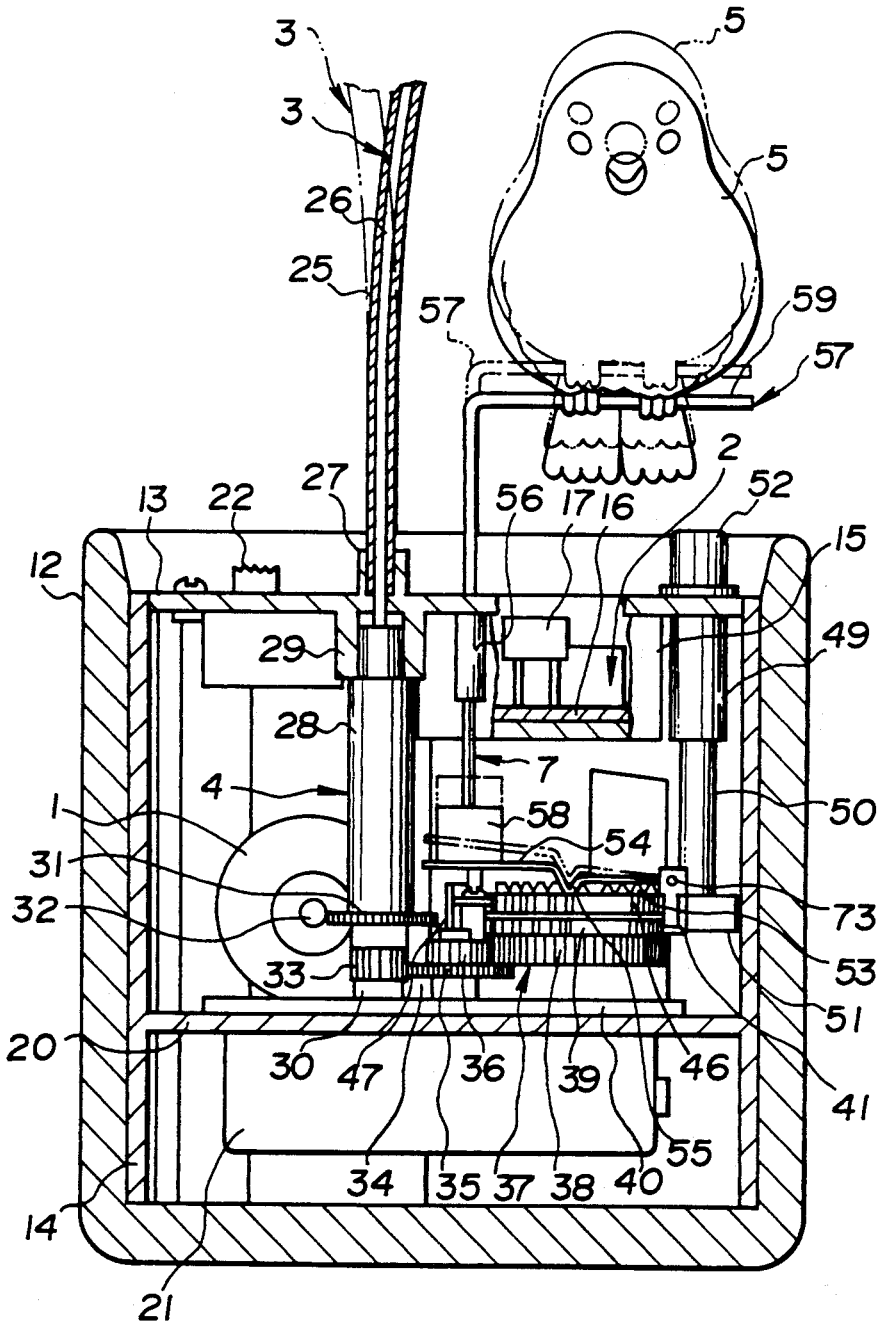
FIG. 2 is an enlarged vertical cross-sectional front elevational view of the artificial-flower toy apparatus illustrated in FIG. 1, showing internal mechanisms within a cup.

Referring first to FIGS. 1 and 2, there is shown an artificial-flower toy apparatus operative in response to sensing of external sound such as hand clapping, a voice of mankind or the like, according to an embodiment of the invention. The artificial-flower toy apparatus comprises a sound-sensing operational mechanism 2 which has an electric motor 1 and which senses the external sound to drive the motor 1. An artificial-flower dancing mechanism 4 is driven by the motor 1 of the sound-sensing operational mechanism 2, to dance a plurality of artificial flowers 3. A crying mechanism 6 (refer to FIG. 3) is interlocked with the artificial-flower dancing mechanism 4 to cry an artificial bird 5 or the like. A vertically moving mechanism 7 is interlocked with the crying mechanism 6 to vertically move the artificial bird 5 or the like. A lightening mechanism 9 (refer to FIG. 4) utilizes current passing through the motor 1 of the sound-sensing operational mechanism 2, to lighten a miniature electric bulb 8.

Figure 5:
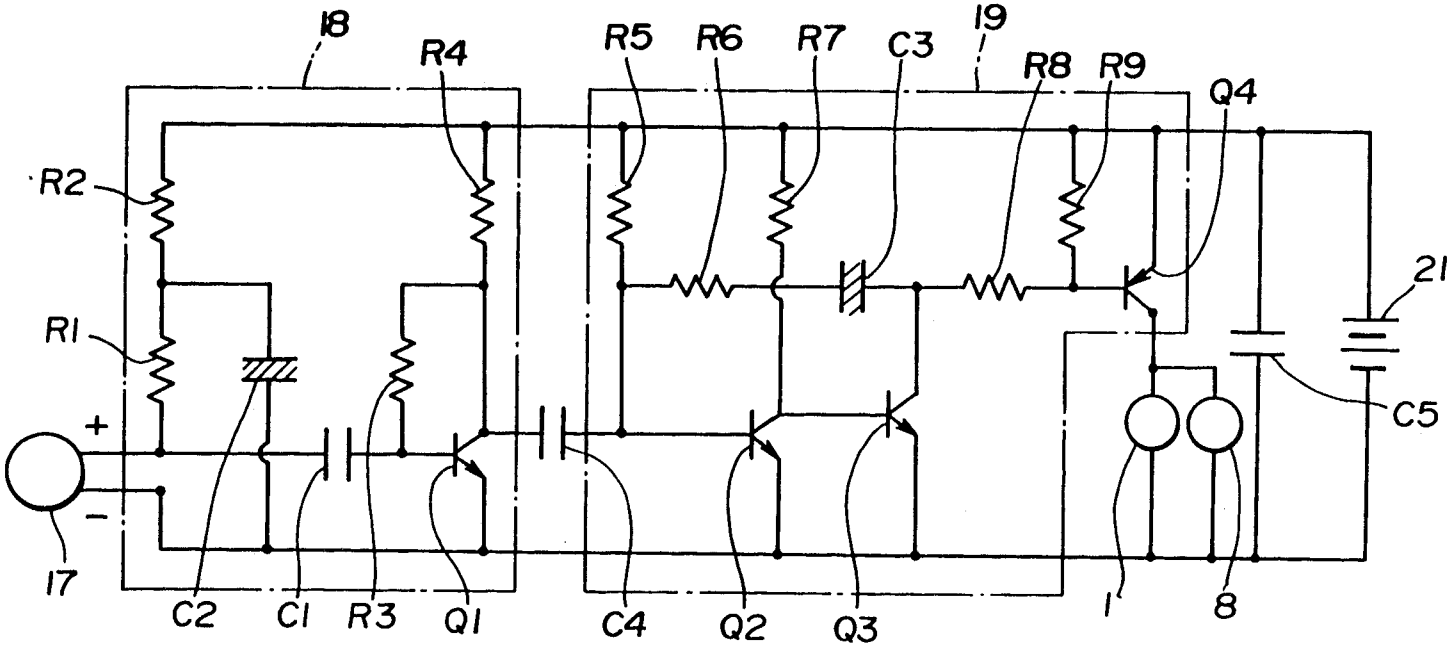
FIG. 5 is a circuit diagram of a sound-sensing operating mechanism illustrated in FIG. 1.

As shown in FIGS. 2 and 5, the sound-sensing operational mechanism 2 is constructed as follows. That is, a container 14 is removably fitted in a cup 12, and a lid or closure 13 is detachably fitted in an opening in an upper surface of the container 14. An accommodating section 15 is provided at a lower surface of the closure 13 of the container 14, and has a top which opens to the outside. A substrate 16 is arranged at the bottom of the accommodating section 15. A microphone 17 for sensing external sound such as hand clapping, a voice of mankind or the like is arranged on the substrate 16. An amplifier circuit 18 is provided which amplifies an electric signal of the external sound. A switching circuit 19 is operative in response to the amplified electric signal to drive the motor 1. The microphone 17, the amplifier circuit 18 and the switching circuit 19 are interlocked with each other.

Specifically, the amplifier circuit 18 comprises four resistors $R_1$, $R_2$, $R_3$ and $R_4$, a capacitor $C_1$, an electrolytic capacitor $C_2$, and an npn transistor $Q_1$. The amplifier circuit 18 has an input terminal which is connected to an output terminal of the microphone 17. The switching circuit 19 comprises five resistors $R_5$, $R_6$, $R_7$, $R_8$ and $R_9$, a pair of npn transistors $Q_2$ and $Q_3$, a pnp transistor $Q_4$, and an electrolytic capacitor $C_3$. The switching circuit 19 has an input terminal which is connected to an output terminal of the amplifier circuit 18 through a capacity $C_4$. The transistor $Q_4$ of the switching circuit 19 has a collector to which the motor 1 arranged within the container 14 is connected. A decoupling capacitor $C_5$ for the entire sound-sensing operational mechanism 2 and at least one dry cell 21 arranged at a lower surface of a bottom plate 20 of the container 14 are connected to an emitter of the transistor $Q_4$ and the output terminal of the motor 1 in parallel relation thereto. A power-source switch 22 is mounted to the upper surface of the closure 13 of the container 14.

Figure 3:
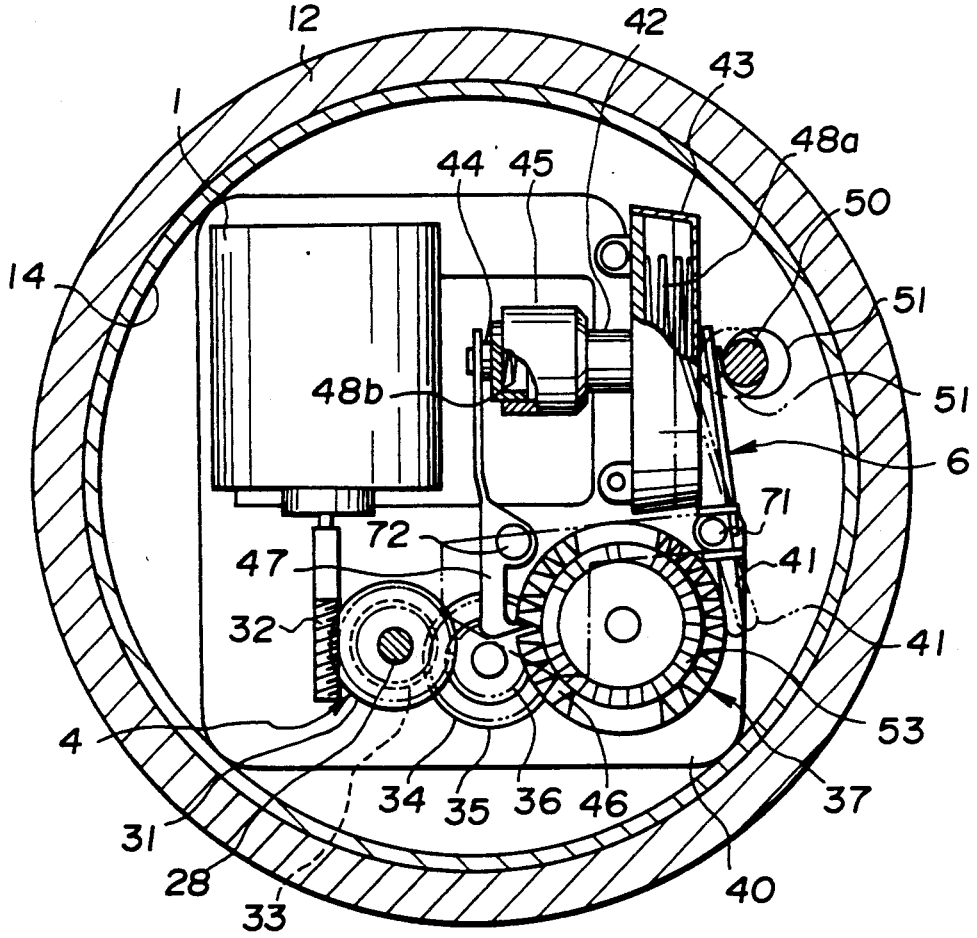
FIG. 3 is an enlarged horizontal cross-sectional top plan view of the artificial-flower toy apparatus illustrated in FIG. 1, showing the internal mechanisms within the cup.

As shown in FIGS. 1 through 3, the artificial-flower dancing mechanism 4 is constructed as follows. That is, each of the artificial flowers 3 has a group of petals 23, a plurality of leaves 24 and a stalk or stem 25. A core rod 26 is inserted in the stem 25 of the artificial flower 3. The artificial flower 3 is mounted, in an upstanding manner, on the closure 13 of the container 14 such that the lower end of the stem 25 is supported by a stem support 27 on the upper surface of the closure 13, and the lower end of the core rod 26 is fitted in the container 14. A section of the core rod 26 within the container 14 is supported by an angularly movable shaft 28 which is supported by a bearing 29 on the lower surface of the closure 13 and a shaft pin 30 on the upper surface of the bottom plate 20 for angular movement about an axis of the angularly movable shaft 28. A worm wheel 31 is mounted to an outer periphery of a lower end of the angularly movable shaft 28 for angular movement therewith about the axis of the latter. The worm wheel 31 is in mesh with a worm 32 which is fixedly mounted to a drive shaft of the motor 1 of the sound-sensing operational mechanism 2.

As shown in FIGS. 2 and 3, the crying mechanism 6 comprises an intermediate gear 34 which has a driving wheel 35 and a driven wheel 36. The driving wheel 35 is in mesh with a small gear 33 which is provided on the outer periphery of the lower end of the angularly movable shaft 28 of the artificial-flower dancing mechanism 4. A driving gear 38 provided on the outer peripheral surface of a lower portion of a cam 37 is in mesh with the driven wheel 36 of the intermediate gear 34. The cam 37 has a bellows operational cam surface 39 which is provided on the outer peripheral surface of an intermediate section of the cam 37.

A crying lever 41 has a substantially central section in the longitudinal direction. The central section of the crying lever 41 is supported on a base 40 by a pivot 71 for angular movement laterally about the pivot 71. The crying lever 41 has one end thereof which is in contact with the bellows operational cam surface 39 . A flute 45 is composed of a flute body 42, a bellows 43 for sending air to the flute body 42, and a music-interval regulating piston 44 which is fitted in the flute body 42. The crying lever 41 has the other end which is supported by an end of the flute 45 adjacent the bellows 43. A music-interval regulating cam surface 46 is provided on the outer peripheral surface of an upper portion of the cam 37. Similarly to the crying lever 41, a music-interval regulating lever 47 has a substantially central section in the longitudinal direction, which is supported on the base 40 by a pivot 72 for angular movement laterally about the pivot 72. The music-interval regulating lever 47 has one end thereof which is in contact with the music-interval regulating cam surface 46. The other end of the music-interval regulating lever 47 is supported by an end of the flute 45 adjacent the piston 44.

Further, a pair of coil springs 48*a* and 48*b* are arranged respectively within the bellows 43 and the piston 44 of the flute 45, for abutting the crying lever 41 and the music-interval regulating lever 47 respectively against the bellows operational cam surface 39 and the music-interval regulating cam surface 46. A crying stop rod 50 is supported on the closure 13 of the container 14 through a support tube 49 for angular movement about a vertical axis of the crying stop rod 50. The crying stop rod 50 has, at its lower end, an eccentric projection 51 which is in contact with the bellows 43 of the flute 45 so as to be capable of being abutted against the bellows 43. A knob 52 for operation from a location above the closure 13 of the container 14 is provided at the upper end of the crying stop rod 50. Thus, operation of the knob 52 enables the eccentric projection 51 to disengage the crying lever 41 from the bellows operational cam surface 39.

As shown in FIGS. 2 and 3, the vertically moving mechanism 7 is constructed as follows. That is, the cam 37 of the crying mechanism 6 has its upper surface which is formed into a vertically moving cam surface 53 in an annular fashion. A vertically movable lever 54 is supported on the base 40 by a pivot 73 for angular movement vertically thereabout. The vertically movable lever 54 has, at its substantially central section in the longitudinal direction, a follower projection 55 which is in contact with the cam surface 53. A vertically movable arm 57 is supported on the closure 13 of the container 14 through a support tube 56 for vertical movement. The vertically movable arm 57 has a lower abutment 58 which is abutted against the upper surface of the forward end of the vertically movable lever 54. The vertically movable arm 57 has an upper horizontal section 59 on which the artificial bird 5 is mounted.

Figure 4:
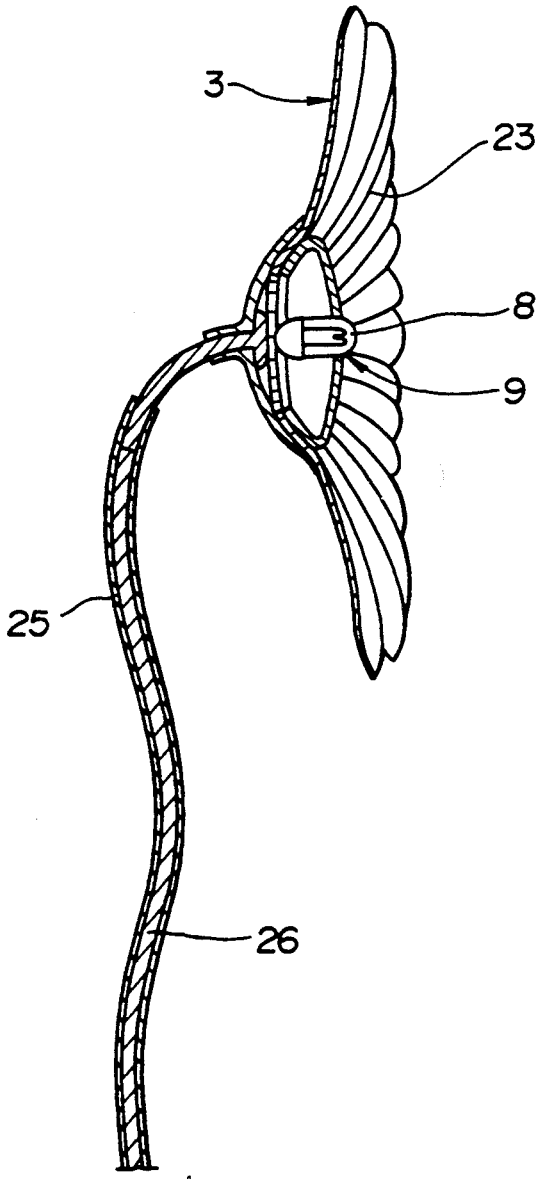
FIG. 4 is a fragmentary vertical cross-sectional view of an upper section of one of a plurality of artificial flowers illustrated in FIG. 1.

As shown in FIGS. 1, 4 and 5, the lightening mechanism 9 is constructed as follows. That is, the miniature electric bulb 8 is fitted in the center of the group of petals 23 of the artificial flower 3 such that a viewer can view the miniature electric bulb 8 from the forward side. The switching circuit 19 of the sound-sensing operational mechanism 2 has the transistor $Q_4$ whose collector has the output terminal connected to the miniature bulb 8 in parallel relation to the motor 1.

Figure 6:
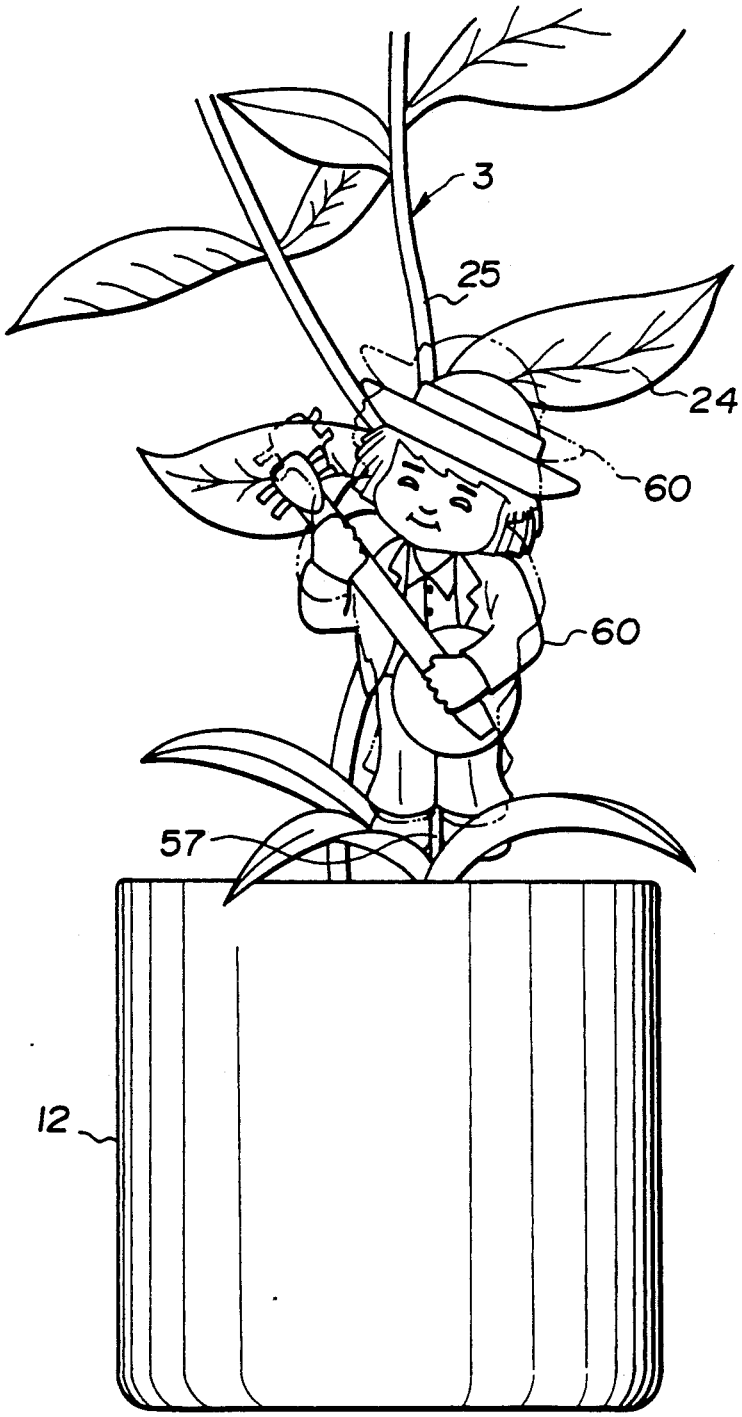
FIG. 6 is a fragmentary front elevational view of another embodiment of a crying mechanism and a vertical moving mechanism.

It has been described and illustrated that, in the crying mechanism 6 and the vertically moving mechanism 7, the artificial bird 5 is mounted to the upper horizontal section 59 of the vertically movable arm 57, in order to cry the artificial bird 5 or to vertically move the same. However, the invention should not be limited to this specific arrangement. As shown in FIG. 6, in place of the artificial bird 5, a doll 60 holding a music instrument or the like may be mounted to the upper horizontal section 59 of the vertically movable arm 57. Alternatively, in place of the artificial bird 5 and the doll 60, other animals may be mounted to the upper horizontal section 59.

The operation of the artificial-flower toy apparatus according to the embodiment of the invention will be described. First, the power-source switch 22 is turned on. When the external sound such as hand clapping, a voice of mankind or the like is given to the artificial-flower toy apparatus, the microphone 17 of the sound-sensing operational mechanism 2 detects or senses the external sound to send an electric signal to the amplifier circuit 18. The electric signal of the external sound is amplified by the amplifier circuit 18. By the amplified electric signal, the transistor $Q_2$ of the switching circuit 19 is turned on. By the turning-on of the transistor $Q_2$, current flows through the base of the transistor $Q_3$ so that the transistor $Q_3$ is turned on. Subsequently, the collector current of the transistor $Q_3$ flows through the base of the transistor $Q_4$ so that the transistor $Q_4$ is turned on. Thus, the motor 1 is driven, and the miniature electric bulb 8 of the lightening mechanism 9 is turned on or lightened. When the worm 32 of the motor 1 is driven, the angularly movable shaft 28 of the artificial-flower dancing mechanism 4 is moved angularly about the axis of the angularly movable shaft 28 through the worm wheel 31. The core rod 26 within the stem 25 of each of the artificial flowers 3 is also moved angularly about the axis of the angularly movable shaft 28, accompanied with the angular movement of the angularly movable shaft 28. Thus, as shown in FIGS. 1 and 2, it can be viewed that the artificial flower 3 dances windingly or meanderingly. Then, the small gear 33 of the artificial-flower dancing mechanism 4 is moved angularly about the axis of the angularly movable shaft 28 so that driving gear 38 on the cam 37 of the crying mechanism 6 is moved angularly about the axis of the cam 37 through the intermediate gear 34. Accompanied with the angular movement of the driving gear 38, the crying lever 41 and the sound-interval regulating lever 47, whose respective one ends are in contact respectively with the bellows operational cam surface 39 and the music-interval regulating cam surface 46, are moved angularly about the pivots 71 and 72 horizontally. Crying sound approximate to the actual or natural bird is generated through the bellows 43 and the piston 44 of the flute 45. Thus, it seems that the artificial bird 5 cries.

Further, the vertically movable lever 54 of the vertically movable mechanism 7 has the follower projection 55 which is in contact with the cam surface 53 of the cam 37 in the crying mechanism 6. The vertically movable lever 54 is moved vertically so that the artificial bird 5, the doll 60 or the like is moved vertically through the vertically movable arm 57.

As described above, the artificial-flower toy apparatus according to the embodiment of the invention comprises the sound-sensing operational mechanism 2 for sensing the external sound such as hand clapping, a voice of mankind or the like to drive the motor 1, and the artificial-flower dancing mechanism 4 for dancing the artificial flowers 3 by the motor 1 of the sound-sensing operational mechanism 2. The artificial flowers 3, each of which has the core rod 26 inserted in the stem 25, are mounted to the container 14 in an upstanding manner. The core rod 26 of the artificial flower 3 has the lower end which is interlocked with the driving shaft of the motor 1 of the sound-sensing operational mechanism 2 through the angularly movable shaft 28. Accordingly, when the sound-sensing operational mechanism 2 senses the external sound such as hand clapping, a voice of mankind or the like, the motor 1 is driven. Accompanied with the driving of the motor 1, the angularly movable shaft 28 of the artificial-flower dancing mechanism 4 is moved angularly about the axis of the angularly movable shaft 28. Accompanied with the angular movement of the angularly movable shaft 28, the core rod 26 within the stem 25 of the artificial flower 3 is moved angularly about the axis of the angularly movable shaft 28 so that it is seen that the artificial flower 3 dances windingly or meanderingly. Thus, the artificial-flower toy apparatus is extremely rich in taste.

Further, the artificial-flower toy apparatus according to the embodiment of the invention comprises the sound-sensing operational mechanism 2 for sensing the external sound such as hand clapping, a voice of mankind or the like to drive the motor 1, and the crying mechanism 6 for crying the toy such as the artificial bird 5, the doll 60 or the like. In the crying mechanism 6, the crying lever 41 has one end thereof which is in contact with the bellows operational cam surface 39 of the cam 37. The other end of the crying lever 41 is supported by the bellows 43 of the flute 45. The sound-interval regulating lever 47 has one end thereof which is in contact with the sound-interval regulating cam surface 46 of the cam 37. The other end of the sound-interval regulating lever 47 is supported by the piston 44 of the flute 45. The driving gear 38 of the cam 37 is interlocked with the driving shaft of the motor 1 of the sound-sensing operational mechanism 2 through the intermediate gear 34 for angular movement about the axis of the cam 37. Further, the crying stop rod 50 is arranged adjacent the bellows 43 of the flute 45 for angular movement about the axis of the crying stop rod 50. The crying stop rod 50 has, at the lower end, the eccentric projection 51 for being abutted against the bellows 43 and, at the upper end, the operational grip 52. Accordingly, the driving gear 38 of the cam 37 of the artificial-flower dancing mechanism 4 is moved angularly about the axis of the cam 37. Accompanied with the angular movement of the driving gear 38, the crying lever 41 having the one end in contact with the bellow operational cam surface 39 is angularly moved laterally about the pivot 71, and the sound-interval regulating lever 47 having the one end in contact with the sound-interval regulating cam 46 is angularly moved laterally about the pivot 72, so that the bellows 43 and the piston 44 of the flute 45 are operated to generate crying sound approximate to a crying voice of a natural bird, a crying voice of a doll or the like. It seems that the toy such as the artificial bird 5, the doll 60 or the like cries. Thus, the artificial-flower toy apparatus is extremely rich in taste.

Moreover, the artificial-flower toy apparatus according to the embodiment of the invention comprises the sound-sensing operational mechanism 2 for sensing the external sound such as hand clapping, a voice of mankind or the like, and the vertically moving mechanism 7 for vertically moving the artificial bird 5, the doll 60 or the like. In the vertically moving mechanism 7, the follower projection 55 at the substantially central section of the vertically moving lever 54 in the longitudinal direction is in contact with the vertical moving cam surface 53 of the cam 37 of the crying mechanism 6. The vertically moving arm 57, in which the artificial bird 5 is mounted to the upper-end horizontal section 59, is supported on the upper surface of the forward end of the vertically moving lever 54 for angular movement about the pivot 73. Accordingly, the follower projection 55 of the vertically moving lever 54 of the vertically moving mechanism 7 is in contact with the vertically moving cam surface 53 of the cam 37 of the crying mechanism 6, and the vertically movable lever 54 is angularly movable vertically about the pivot 73. Further, the toy such the artificial bird 5, the doll 60 or the like is moved vertically through the vertically movable arm 57. Thus, the artificial-flower toy apparatus is extremely rich in taste.

Furthermore, the artificial-flower toy apparatus according to the embodiment of the invention comprises the sound-sensing operational mechanism 2 for sensing the external sound such as hand clapping, a voice of mankind or the like to drive the motor 1, and the lightening mechanism 9 for utilizing the current flowing through the motor 1 of the sound-sensing operational mechanism 2 to lighten the miniature electric bulb 8. The miniature electric bulb 8 is fitted in the center of the group of pastes 23 of each of the artificial flowers 3. Accordingly, in response to driving of the motor 1 of the sound-sensing operational mechanism 2, the miniature electric bulb 8 at the center of the group of petals 23 of the artificial flower 3 is lightened. Thus, the artificial-flower toy apparatus is extremely rich in taste.

Further, the artificial-flower toy apparatus according to the embodiment of the invention comprises the sound-sensing operational mechanism 2 for sensing the external sound such as hand clapping, a voice of mankind or the like to drive the motor 1, the artificial-flower dancing mechanism 4 for dancing the artificial flower 3 by the motor 1 of the sound-sensing operational mechanism 2, the crying mechanism 6 interlocked with the artificial-flower dancing mechanism 4 to cry the artificial bird 5 or the like, the vertically moving mechanism 7 interlocked with the crying mechanism 6 to vertically move the artificial bird 5 or the like, and the lightening mechanism 9 for utilizing the current flowing through the motor 1 of the sound-sensing operational mechanism 2 to lighten the miniature electric bulb 8. Accordingly, the sound-sensing operational mechanism 2 senses the external sound such as hand clapping, a voice of mankind or the like to drive the motor 1. Accompanied with the driving of the motor 1, the artificial flower 3 dances windingly or meanderingly, the toy such as the artificial bird 5, the doll 60 or the like is moved vertically, and the miniature electric bulb 8 at the center of the group of petals 23 of the artificial flower 3 is lightened. In this manner, various mechanisms including the sound-sensing operational mechanism 2, the artificial-flower dancing mechanism 4, the crying mechanism 6, the vertically moving mechanism 9 and the lightening mechanism 9 are operated simultaneously. Thus, the artificial-flower toy apparatus is further rich in taste.

What is claimed is:

1. A sound-sensing dancing toy operative in response to the sensing of external sound, comprising:

a container;

sound-sensing operational means contained within said container and including motor means having driving shaft means, said sound-sensing operational means sensing the external sound to drive said motor means;

artificial-flower dancing means supported in said container and including angularly movable shaft means and at least one artificial flower which has a stem and a core rod inserted in said stem, said core rod of said artificial flower having a lower end portion which is connected to said angularly movable shaft means for angular movement therewith about an axis of said angularly movable shaft means, said artificial flower being mounted on said container in an upstanding manner, wherein said angularly movable shaft means is connected to said driving shaft means of said angularly movable shaft means, so that said artificial flower is danced by said motor means of said sound-sensing operational means, a crying means including flute means having piston means and bellows means;

cam means having driving gear means, a bellows operational cam surface and a sound-interval regulating cam surface;

crying lever means having one end thereof in contact with said bellows operational cam surface and the other end supported by said bellow means;

sound-interval regulating lever means having one end thereof in contact with said sound-interval regulating cam surface of said cam means and the other end supported by said piston means of said flute means;

intermediate gear means through which said driving gear means of said cam means is connected to said driving shaft means of said motor means for angular movement about an axis of said cam means; and crying stop means located at said bellows means of said flute means for angular movement about an axis of said crying stop means, wherein said crying stop means has, at its lower end, eccentric projection means for abutting against said bellows means and, at an upper end, operational knob means for angularly moving said eccentric projection means about the axis of said crying stop means to abut said eccentric projection means against said bellows means thereby disengaging said crying lever means from said bellows operational cam surface.

2. The sound-sensing dancing toy according to claim 1, wherein said cam means further includes a vertically driving cam surface having different heights, wherein said artificial-flower toy apparatus further includes vertically moving means for vertically moving said toy, said vertically moving means comprising:

vertically movable lever means having a substantially central section in a longitudinal direction of said said vertically movable lever means, and follower projection means arranged at said substantially central section; and vertically moving arm means having an upper horizontal section on which said toy is mounted, wherein said flower projection means is in contact with said vertically driving cam surface of said cam means, and wherein said vertically movable arm means is supported by a forward end of said vertically movable lever means so that said vertically movable arm means is movable vertically due to rotation of said cam means.

3. The sound-sensing dancing toy according to claim 3, wherein said crying means is connected with said artificial-flower dancing means for crying said toy, and said vertically moving means is connected with said crying means to vertically move said toy.

4. The sound-sensing dancing toy according to claim 1, further including lightening means having at least one miniature electric bulb which is fitted in a center of a group of petals of said artificial flower, wherein said lightening means utilizes current flowing through said motor means of said sound-sensing operational means to lighten said miniature electric bulb.

5. The sound-sensing dancing toy according to claim 1, further including:

at least one toy;

crying means connected with said artificial-flower dancing means for crying said toy;

vertically moving means connected with said crying means for vertically moving said toy; and lightening means having at least one miniature electric bulb which is fitted in a center of a group of petals of said artificial flower, wherein said lightening means utilizes current flowing through said motor means of said sound-sensing operational means to lighten said miniature electric bulb.

6. The sound-sensing dancing toy according to claim 1, further including a cup within which said container is received.

7. The sound-sensing dancing toy according to claim 1, wherein said sound-sensing operational means includes a microphone for sensing the external sound to generate an electric signal, an amplifier circuit for amplifying said electric signal of the external sound, and a switching circuit for driving said motor means on the basis of the amplified electric signal.

8. The sound-sensing dancing toy according to claim 1, wherein said artificial flower further includes at least one leaf mounted to said stem.

9. The sound-sensing dancing toy according to claim 1, wherein said artificial-flower dancing means includes a worm wheel mounted on an outer peripheral surface of a lower end of said angularly movable shaft means, and a worm fixedly mounted to said driving shaft of said motor means of said sound-sensing operational means for rotation with said driving shaft means, said worm wheel being in mesh with said worm.

* * * * *